US008179322B2

(12) United States Patent
Nissinen

(10) Patent No.: US 8,179,322 B2
(45) Date of Patent: May 15, 2012

(54) DUAL ANTENNA APPARATUS AND METHODS

(75) Inventor: Pertti Nissinen, Kempele (FI)

(73) Assignee: Pulse Finland Oy, Kempele (FI)

( * ) Notice: Subject to any disclaimer, the term of this patent is extended or adjusted under 35 U.S.C. 154(b) by 852 days.

(21) Appl. No.: 12/009,009

(22) Filed: Jan. 15, 2008

(65) Prior Publication Data

US 2008/0204328 A1 Aug. 28, 2008

(30) Foreign Application Priority Data

Sep. 28, 2007 (FI) ..... 20075687

(51) Int. Cl.
*H01Q 1/38* (2006.01)

(52) U.S. Cl. ..... 343/700 MS

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 5,043,738 | A * | 8/1991 | Shapiro et al. | 343/700 MS |
| 5,389,937 | A * | 2/1995 | Kaloi | 343/700 MS |
| 5,557,292 | A | 9/1996 | Nygren et al. | |
| 6,100,849 | A | 8/2000 | Tsubaki et al. | |
| 6,133,879 | A | 10/2000 | Grangeat et al. | |
| 6,147,650 | A | 11/2000 | Kawahata et al. | |
| 6,177,908 | B1 | 1/2001 | Kawahata | |
| 6,316,975 | B1 | 11/2001 | O'Toole et al. | |
| 6,407,171 | B1 * | 6/2002 | Agarwal et al. | 525/191 |
| 6,473,056 | B2 | 10/2002 | Annamaa | |
| 6,606,016 | B2 | 8/2003 | Takamine et al. | |
| 6,614,400 | B2 | 9/2003 | Egorov | |
| 6,738,022 | B2 | 5/2004 | Klaavo et al. | |
| 6,862,441 | B2 | 3/2005 | Ella | |
| 6,903,692 | B2 | 6/2005 | Kivekas et al. | |
| 7,057,560 | B2 | 6/2006 | Erkocevic | |
| 7,142,824 | B2 | 11/2006 | Kojima et al. | |
| 7,148,849 | B2 | 12/2006 | Lin | |
| 7,148,851 | B2 | 12/2006 | Takaki et al. | |
| 7,170,464 | B2 | 1/2007 | Tang et al. | |
| 7,176,838 | B1 | 2/2007 | Kinezos | |

(Continued)

FOREIGN PATENT DOCUMENTS

CN 1747234 A 3/2006

(Continued)

OTHER PUBLICATIONS

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., pp. 15-24, waelsall@rockwellcollins.com and blhauck@rockwellcollins.com.

(Continued)

*Primary Examiner* — Huedung Mancuso
(74) *Attorney, Agent, or Firm* — Gazdzinski & Associates, PC

(57) ABSTRACT

A dielectric dual antenna apparatus intended for applications such as small-sized radio frequency devices. The dual antenna comprises a first partial antenna which implements the lower operating band of the antenna and another partial antenna implementing the upper operating band. The partial antennas have a shared substrate, which together with the radiators constitutes an integrated antenna component. The matching of the dual antenna can be improved in either operating band without degrading it in the other operating band at the same time. Methods of operating the aforementioned apparatus are also disclosed.

41 Claims, 6 Drawing Sheets

U.S. PATENT DOCUMENTS

| | | | | |
|---|---|---|---|---|
| 7,180,455 | B2 | 2/2007 | Oh et al. | |
| 7,205,942 | B2 | 4/2007 | Wang et al. | |
| 7,218,282 | B2 | 5/2007 | Humpfer et al. | |
| 7,224,313 | B2 | 5/2007 | McKinzie, III et al. | |
| 7,274,334 | B2 | 9/2007 | O'Riordan et al. | |
| 7,283,097 | B2 | 10/2007 | Wen et al. | |
| 7,289,064 | B2 | 10/2007 | Cheng | |
| 7,292,200 | B2 | 11/2007 | Posluszny et al. | |
| 7,330,153 | B2 | 2/2008 | Rentz | |
| 7,333,067 | B2 | 2/2008 | Hung et al. | |
| 7,339,528 | B2 | 3/2008 | Wanf et al. | |
| 7,345,634 | B2 | 3/2008 | Ozkar et al. | |
| 7,352,326 | B2 | 4/2008 | Korva | |
| 7,358,902 | B2 | 4/2008 | Erkocevic | |
| 7,385,556 | B2 | 6/2008 | Chung et al. | |
| 7,417,588 | B2 | 8/2008 | Castany et al. | |
| 7,423,592 | B2 | 9/2008 | Pros et al. | |
| 7,468,700 | B2 | 12/2008 | Milosavlejevic et al. | |
| 7,589,678 | B2 | 9/2009 | Perunka et al. | |
| 2001/0050654 | A1* | 12/2001 | Killen et al. | 343/817 |
| 2002/0145569 | A1 | 10/2002 | Onaka et al. | |
| 2002/0163470 | A1 | 11/2002 | Nagumo et al. | |
| 2002/0196192 | A1 | 12/2002 | Nagumo et al. | |
| 2003/0006936 | A1 | 1/2003 | Aoyama et al. | |
| 2003/0020659 | A1 | 1/2003 | Kushihi et al. | |
| 2003/0222827 | A1 | 12/2003 | Sung | |
| 2004/0021607 | A1 | 2/2004 | Legay | |
| 2004/0085244 | A1 | 5/2004 | Kadambi et al. | |
| 2004/0212493 | A1 | 10/2004 | Stilp | |
| 2005/0024268 | A1 | 2/2005 | McKinzie, III et al. | |
| 2005/0057416 | A1 | 3/2005 | Yuanzhu | |
| 2005/0078037 | A1 | 4/2005 | Leclerc et al. | |
| 2005/0099347 | A1 | 5/2005 | Yamaki | |
| 2005/0243001 | A1 | 11/2005 | Miyata et al. | |
| 2006/0017621 | A1* | 1/2006 | Okawara et al. | 343/700 MS |
| 2006/0145924 | A1 | 7/2006 | Chen et al. | |
| 2007/0109202 | A1 | 5/2007 | Vance | |
| 2007/0139277 | A1 | 6/2007 | Nissinen | |
| 2007/0152881 | A1 | 7/2007 | Chan | |
| 2007/0152885 | A1 | 7/2007 | Sorvala | |
| 2007/0152887 | A1 | 7/2007 | Castany et al. | |
| 2007/0159399 | A1 | 7/2007 | Perunka | |
| 2007/0171131 | A1 | 7/2007 | Sorvala | |
| 2007/0241970 | A1 | 10/2007 | Thornell-Pers | |
| 2007/0268190 | A1 | 11/2007 | Huynh | |
| 2007/0273606 | A1 | 11/2007 | Mark et al. | |
| 2007/0290938 | A1 | 12/2007 | Loyet | |
| 2008/0007459 | A1 | 1/2008 | Koskiniemi | |
| 2008/0042903 | A1 | 2/2008 | Cheng | |
| 2008/0088511 | A1 | 4/2008 | Sorvala | |

FOREIGN PATENT DOCUMENTS

| | | | |
|---|---|---|---|
| DE | 101 50 149 | A1 | 4/2003 |
| EP | 0766341 | A1 | 4/1997 |
| EP | 0 831 547 | A2 | 3/1998 |
| EP | 0 942 488 | A2 | 6/1999 |
| EP | 1003240 | A2 | 5/2000 |
| EP | 1 162 688 | A1 | 12/2001 |
| EP | 1 294 049 | A1 | 3/2003 |
| EP | 1 414 108 | A2 | 4/2004 |
| EP | 1 791 213 | | 5/2007 |
| FI | 20055621 | | 11/2005 |
| JP | 2001-217631 | | 10/2001 |
| WO | WO 00/36700 | | 6/2000 |
| WO | WO 01/33665 | A1 | 5/2001 |
| WO | WO 02/11236 | A1 | 2/2002 |
| WO | WO 02/078123 | A1 | 10/2002 |
| WO | WO 2004/112189 | A1 | 12/2004 |
| WO | WO 2006/000631 | A1 | 1/2006 |
| WO | WO 2006/000650 | | 1/2006 |
| WO | WO 2006/084951 | | 7/2006 |
| WO | WO 2007000483 | A1 | 1/2007 |

OTHER PUBLICATIONS

Product of the Month, RFDesign, "GSM/GPRS Quad Band Power Amp Includes Antenna Switch," 1 page, reprinted Nov. 2004 issue of RF Design (www.rfdesign.com) Copyright 2004, Freescale Semiconductor, RFD-24-EK.

* cited by examiner

DUAL ANTENNA APPARATUS AND METHODS

PRIORITY AND RELATED APPLICATIONS

This application claims priority to Finland Patent Application No. 20075687 filed Sep. 28, 2007 and entitled "Dual Antenna", which is incorporated herein by reference in its entirety. This application is related to co-owned U.S. Pat. No. 7,589,678, issued Sep. 15, 2009 entitled "Multi-Band Antenna With a Common Resonant Feed Structure and Methods", and co-owned U.S. Pat. No. 7,663,551, issued Feb. 16, 2010 and entitled "Multiband Antenna Apparatus and Methods", each also incorporated herein by reference in its entirety. This application is also related to co-owned U.S. Pat. No. 7,786,938, issued Aug. 31, 2010 and entitled "Antenna, Component And Methods", and U.S. Pat. No. 7,679,565 issued Mar. 16, 2010 and entitled "Chip Antenna Apparatus and Methods", both of which are incorporated herein by reference in their entirety. This application is further related to U.S. patent application Ser. Nos. 11/901,611 filed Sep. 17, 2007 entitled "Antenna Component and Methods", 11/883,945 filed Aug. 6, 2007 entitled "Internal Monopole Antenna", and 11/801,894 filed May 10, 2007 entitled "Antenna Component", and 11/_____ entitled "Internal multiband antenna and methods" filed Dec. 28, 2007, each of the foregoing incorporated by reference herein in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The invention relates to an antenna structure that may be used for example in a small-sized radio or communications apparatus, the structure of which in one exemplary embodiment comprises two electrically and relatively separate parts for implementing two operating bands.

2. Description of Related Technology

In small-sized portable radio apparatus, such as mobile phones, the antenna is placed for convenience of use preferably inside the covers of the apparatus. Furthermore, as one tries to make the antenna to consume as small a space as possible, its design becomes demanding. Additional difficulties in design are caused if the radio apparatus has to operate in several frequency ranges, the more the broader these ranges are.

Internal antennas are mostly plane-structured, in which case they comprise a radiating plane and a ground plane at a certain distance from it. A planar antenna can be made smaller by manufacturing the radiating plane on the surface of a dielectric substrate instead of it being air-insulated. The higher the permittivity of the material, the smaller, naturally, an antenna element with a certain electric size is physically. By using e.g. ceramics having a high dielectric constant as the substrate, the antenna component becomes a chip to be mounted on a circuit board.

FIG. 1 shows an example of a dielectric antenna, or an antenna based on such a chip component. The structure is a dual antenna; it includes two antenna components with a ceramic substrate on the circuit board PCB of a radio device and the partial antennas corresponding to them. The antenna structure has a lower and an upper resonance, and it has correspondingly two bands: the lower operating band is implemented by the first antenna component 110 and the upper operating band by the second antenna component 120. On the surface of the substrate of the first antenna components there are two antenna elements with same size, between which elements remains a relatively narrow slot on the top surface of the substrate. The feed conductor of the partial antenna in question leads to one element, and the other element is a parasitic element connected to the ground GND and getting its feed electromagnetically over said slot. On the surface of the substrate of the second antenna component 120 there is in this case one antenna element, which is connected both to the feed conductor of the partial antenna in question and to the ground. There is no ground plane below the antenna components, and the ground plane beside them is at a certain distance from them to match the partial antennas.

Because of the separateness of the antenna components, also their electromagnetic near fields are separate, and the isolation between the partial antennas is good in this respect. The partial antennas have a shared feed conductor 131 connected to the antenna port AP of the radio apparatus, which conductor branches to feed conductors leading to the antenna components. If these feed conductor branches were connected directly to the radiating elements, the partial antennas would adversely affect each other via their shared feed so that the tuning of one would change the tuning of the other. Furthermore, the upper resonance would easily become weak or it would not excite at all. For this reason the structure requires matching components. In the example of FIG. 1, in series with the feed conductor of the first antenna component 110 there are a coil L1 and a capacitor C1. The natural frequency of the resonance circuit constituted by these is the same as the centre frequency of the lower operating band. In series with the feed conductor of the second antenna component 120 there is a capacitor C2, and between its end on the side of the antenna component and the ground plane GND there is a coil L2. The boundary frequency of the high-pass filter constituted by the capacitor C2 and the coil L2 is somewhat below the upper operating band.

A disadvantage of the solution according to FIG. 1 is the space required by the matching components on the circuit board and additional costs in production incurred by them. It is conceivable that the required matching is made without discrete components with conductor patterns on the surface of the circuit board, but in any case this kind of patterns would require a relatively large area on the circuit board.

FIG. 2 shows another example of a known dual antenna. There the partial antennas have a shared substrate 240, which together with the radiating elements constitutes an antenna component 200. Only this antenna component seen from above and sideways is presented in FIG. 2. Also the ground plane on the circuit board of the radio apparatus, on which the antenna component is mounted, belongs functionally to the antenna. The lower operating band of the whole antenna structure is implemented by the first partial antenna and the upper operating band by the second partial antenna.

The substrate 240 is divided to the substrate of the first partial antenna, or the first partial substrate 241, and the substrate of the second partial antenna, or the second partial substrate 242. The partial substrates are here separated from each other by three holes HL1, HL2, HL3 extending vertically through the substrate and by two grooves CH1, CH2. The first groove CH1 is at the holes downwards from the top surface of the substrate and the second groove CH2 is at the holes upwards from the bottom surface of the substrate. Thus four relatively narrow necks remain to connect the partial substrates. In this way the electrical isolation and the matching possibilities of the partial antennas are improved.

The first partial antenna comprises the first 211 and second 212 radiating element. The first radiating element 211 covers one portion of the top surface of the partial substrate 241 and extends through said holes a bit on the side of the bottom surface of the substrate to constitute the contact pad 217. The first radiating element is connected to the feed conductor through that contact pad, which then is the shared feed point of the partial antennas. The second antenna element 212 covers another portion of the top surface of the partial substrate 241 and extends through its head surface a bit on the side of the bottom surface of the substrate to constitute the contact pads 219. The second radiating element is connected to the signal ground through these contact pads. The second radiating element is then parasitic; it gets its feed electromagnetically over the narrow slot between the elements. The second partial antenna comprises the third radiating element 221. This element covers at least partly the top surface and the outer head surface of the second partial substrate 242.

The second partial antenna gets its feed galvanically through the first radiating element 211 and an intermediate conductor 232. The intermediate conductor is located in this example on one side surface of the substrate 240, which is coated by conductor so that the opposing ends of the first and third radiating element become coupled to each other. In this case the intermediate conductor 232 has to go round the end of the first groove CH1 thus forming a U-shaped bend.

Because of the mutual position of the partial substrates, the main direction of the radiating elements of the first partial antenna and the main direction of the radiating element of the second partial antenna are opposing seen from the shared feed point. This improves from its part the electrical isolation and matching of the partial antennas.

A disadvantage of the above-described dual antenna solutions is that the matching of the antenna both in the lower and upper operating band requires arrangements which increase the production costs, and nevertheless the optimal result is not such as desired.

SUMMARY OF THE INVENTION

The present invention addresses the foregoing needs by disclosing apparatus and methods for a multiband antenna, including an antenna component.

In a first aspect of the invention, a multiband antenna is disclosed. In a first embodiment, the multiband antenna comprises a dual band antenna which comprises a substrate comprising a width and a length, the substrate further comprising: a first antenna operating at a first operating band; and a second antenna operating at a second operating band, the second operating band substantially differing from the first operating band. The first antenna and the second antenna share a feed point and a feed conductor, and at least one of the first or second antennas comprises a first radiator and a second radiator, and at least one of the antennas comprises a third radiator; and the first radiator comprises the feed point and the second radiator comprises a first end and a second end, the second end coupled to a ground and disposed farther from the first radiator than the first end.

In one variant, the length is larger than the width, and the first radiator further comprises at least one short circuit point and at least one short circuit conductor associated therewith, the distance between the at least one short circuit point and the feed point being no larger than the width.

In another variant the number of the at least one short circuit points is one, the short-circuit conductor located on a back surface of the substrate opposite a front surface comprising the feed conductor.

In yet another variant, the number of the at least one short circuit points is one, the short-circuit conductor located on the same surface as the feed conductor.

In still another variant, the number of the at least one short circuit points is two, and wherein a first short-circuit conductor comprising a first short-circuit point is located on the same surface of the substrate as the feed conductor, and a second short-circuit conductor comprising a second short-circuit point is located on the same surface of the substrate as the feed conductor and on the opposite side of the feed conductor as the first short-circuit conductor.

In a further variant, the number of the at least one short circuit points is two, and a first short-circuit conductor comprising a first short-circuit point is located on the same surface of the substrate as the feed conductor and a second short-circuit conductor comprising a second short-circuit point is located on a surface of the substrate opposite the feed conductor and the first short-circuit conductor.

In another variant, the first and second radiators are separated from each other by a narrow slot. The first radiator may wholly be located on an upper surface of the substrate. As another option, at least one of the first or second radiators extends from an upper surface of the substrate to a front or a back surface.

In a second aspect of the invention, a method of operating a dual band antenna is disclosed. In one embodiment, the antenna comprises one partial antenna associated with a lower operating band of the antenna and a second partial antenna associated with an upper operating band, the partial antennas having a shared substrate, a shared feed point, and the method comprises: operating at least one of the partial antennas as two radiators; operating the first radiator and the radiator of the other partial antenna, which joins the shared feed point, as a unitary common element on the substrate surface; and short-circuiting the common element to ground from at least one point proximate to the feed point.

In one variant, one of the lower and upper bands comprises a global positioning system (GPS) band, and one of the lower and upper bands comprises a wireless local area network (WLAN) band.

In a third aspect of the invention, an antenna component for use in a radio frequency device is disclosed. In one embodiment, the component comprises: a first partial antenna implementing a lower operating band; and a second partial antenna implementing an upper operating band, the first and second partial antennas comprising a shared dielectric substrate. The first and second partial antennas comprise a shared feed point and a shared feed conductor disposed on a front surface of the substrate.

In one variant, a part of the antenna component in a first direction relative to a cross-section of the substrate which leads through the feed point is associated with the first partial antenna, and a part of the antenna component in the opposite direction is associated with the second partial antenna.

In another variant, at least one of the first or second partial antennas comprises two radiators, the first of which joins galvanically at the feed point, and the second of which is connected to a ground plane from an outer end; and wherein the first radiator and a radiator of the other partial antenna joining the shared feed point form a unitary common element on the upper surface of the substrate.

In yet another variant, the unitary common element is connected to the ground plane from at least one short-circuit point proximate to the feed point.

In a further variant, at least one short-circuit point comprises one point of the unitary common element, and further comprising a short-circuit conductor in communication with the one point and located on a back surface of the substrate opposite the feed conductor.

In still another variant, the component further comprises a short-circuit conductor starting from the at least one point and located on the front surface of the substrate.

In another variant, the at least one short-circuit point of the common element comprises first and second points, and the component further comprises a first short-circuit conductor starting from the first short-circuit point and located at least partly on the front surface of the substrate on one side of the feed conductor, and a second short-circuit conductor starting from the second short-circuit point located at least partly on the front surface of the substrate on the other side of the feed conductor than the first short-circuit conductor.

In a further variant, the component further comprises a reactive matching component connected between an antenna feed conductor and a signal ground.

In still another variant, the shared substrate comprises a ceramic material.

In a fourth aspect of the invention, a dual antenna of a radio device is disclosed. In one embodiment, the antenna comprises: a first partial antenna to implement a lower operating band of the antenna; and a second partial antenna to implement an upper operating band, the first and second partial antennas having a shared dielectric substrate which forms an integrated antenna component together with antenna radiators, the partial antennas having a shared feed point and a shared feed conductor on the front surface of the substrate. A part of the antenna component in one direction from a substrate cross section which leads through the feed point belongs to the first partial antenna, and a part of the antenna component in the opposite direction belongs to the second partial antenna. At least one partial antenna comprises two radiators, the first of which joins the feed point and the second of which is adapted for connection to a ground plane, and the first radiator and a radiator of the other partial antenna joining the shared feed point form a unitary common element on the upper surface of the substrate, which element is configured for connection to the ground plane from at least one short-circuit point proximate to the feed point.

In one variant, the at least one the short-circuit point comprises a single point, and the antenna further comprises a short-circuit conductor communicating with the single point is located on back surface of the substrate substantially opposite the feed conductor.

In another variant, the at least one short-circuit point comprises a single point, and a short-circuit conductor communicating with the single point is located in majority on the front surface of the substrate on at least one side of the feed conductor.

In yet another variant, the at least one point comprises first and second points, and a first short-circuit conductor communicating with the first short-circuit point is located substantially on the front surface of the substrate on one side of the feed conductor, and a second short-circuit conductor communicating with the second short-circuit point is located substantially on the front surface of the substrate on the other side of the feed conductor.

In a fifth aspect of the invention, an integrated dual-band antenna is disclosed. In one embodiment, the antenna comprises: at least first and second partial antennas disposed on a common substrate; and a shared feed point adapted for matching in both of the operating bands, the antenna comprising at least one short-circuit point disposed proximate to a feed point to permit the matching.

In one variant, the antenna is adapted for the matching in either of the two bands without significantly degrading the matching in the other of the two bands.

In another variant, isolation between the first and second partial antennas is maintained despite the common substrate.

BRIEF DESCRIPTION OF THE DRAWINGS

In the following, the invention will be described in detail. Reference will be made to the accompanying drawings, in which.

DETAILED DESCRIPTION OF THE INVENTION

Reference is now made to the drawings wherein like numerals refer to like parts throughout.

As used herein, the terms "wireless", "radio" and "radio frequency" refer without limitation to any wireless signal, data, communication, or other interface or radiating component including without limitation Wi-Fi, Bluetooth, 3G (3GPP/3GPPS), HSDPA/HSUPA, TDMA, CDMA (e.g., IS-95A, WCDMA, etc.), FHSS, DSSS, GSM, UMTS, PAN/802.15, WiMAX (802.16), 802.20, narrowband/FDMA, OFDM, PCS/DCS, analog cellular, CDPD, satellite systems, millimeter wave, or microwave systems.

Overview

The present invention discloses, inter alia, improved dual antenna apparatus and methods. In one exemplary embodiment, the dielectric antenna is a dual antenna, one partial antenna of which is implemented the lower operating band of the antenna and the other partial antenna the upper operating band. The partial antennas have a shared substrate, which together with the radiators constitutes an integrated antenna component. The partial antennas also have a shared feed point, the part of the antenna component to one direction from the plane, which leads through the feed point and is perpendicular to the upper surface of the substrate, belonging to one partial antenna and the part of the antenna component to the opposite direction belonging to the other partial antenna. At least one of the partial antennas comprises two radiators, the first one of which joins the feed point and the second one is connected to the ground from its outer end as viewed from the first radiator. This first radiator and the radiator of the other partial antenna, which joins the shared feed point, form a unitary common element on the substrate surface. This common element is short-circuited to the ground from at least one point relatively near to the feed point.

One salient advantage of the invention is that an integrated dual antenna provided with a shared feed point can be matched relatively easily in its both operating bands. This is due to the fact that the short-circuits near to the feed point itself improve the total matching of the antenna, and further enable an additional improvement of the matching by extra component in either operating band without degrading the matching in the other operating band at the same time. Relating to the matching improvement, the isolation between the partial antennas is maintained, although they have the shared substrate.

Another advantage of the invention is high antenna efficiency in spite of the small size of the antenna.

DESCRIPTION OF EXEMPLARY EMBODIMENTS

Figure 1:
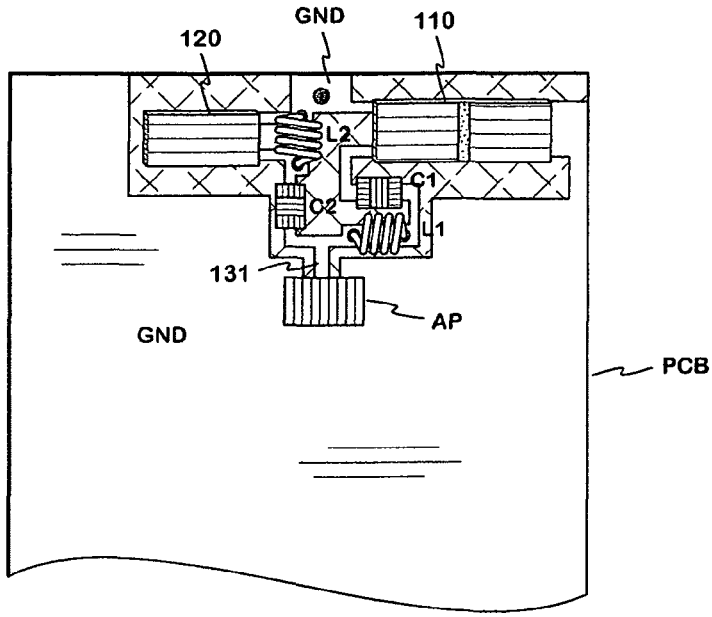
Fig. 1 PRIOR ART
FIG. 1 shows an example of a prior art dielectric dual antenna.
Figure 2:
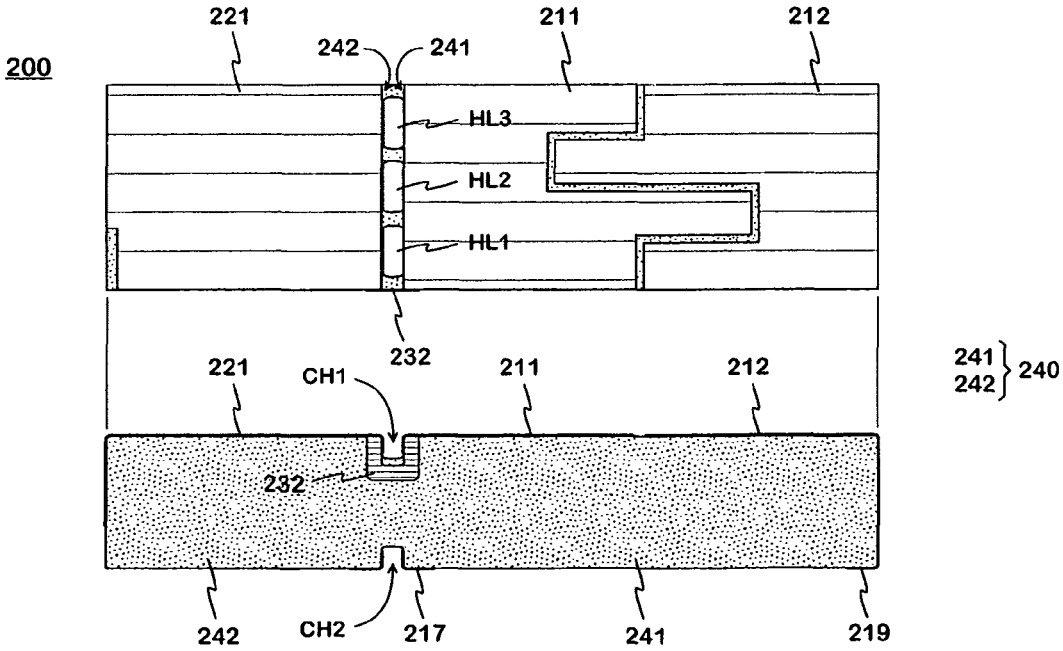
Fig. 2 PRIOR ART
FIG. 2 shows another example of a prior art dielectric dual antenna.

Exemplary embodiments of the invention will now be described in detail. The description refers to the accompanying drawings in which FIGS. 1 and 2 were already described in connection with the description of prior art.

Figure 3:
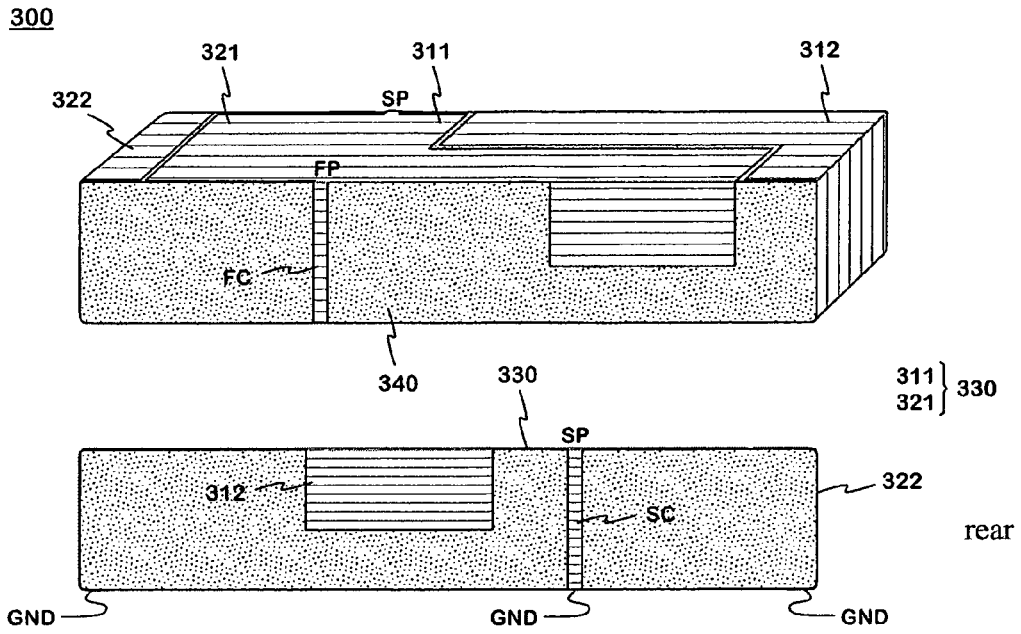
FIG. 3 shows an exemplary embodiment of a dielectric dual antenna according to the invention.

FIG. 3 shows an example of a dielectric dual antenna according to the invention. There are the first partial antenna, by which the lower operating band of the whole antenna is implemented and the second partial antenna, by which its upper operating band is implemented. In the figure the antenna component 300 is seen from the front side as a perspective depiction and in the second partial figure from the back side. Also the ground plane on the circuit board of the radio apparatus, on which the antenna component is mounted, belongs functionally to the antenna. The integrated antenna component 300 comprises a substrate 340 shared between the partial antennas and the radiating elements of the antenna as conductor coatings of the substrate. The substrate 340 is here an elongated ceramic piece substantially shaped like a right-angled prism without any holes or grooves which would divide the piece. The number of the radiating elements is three in this example: the common element 330 according to the invention, the first end element 312 and the second end element 322.

On the front surface of the substrate there is a conductor strip FC belonging to the antenna feed conductor and joining galvanically the common element 330 at the feed point FP. The feed conductor FC and the feed point FP are shared between the partial antennas. The feed point functionally divides the antenna component into two parts so that starting from the substrate cross section which leads through the feed point, the part towards the first end element 312 belongs to the first partial antenna and the part of the antenna component to the opposite direction, or towards the second end element 322, belongs to the second partial antenna. The common element 330 functionally comprises two parts: the first radiator 311 of the first partial antenna and the first radiator 321 of the second partial antenna. In this case the first end element 312 is the second radiator of the first partial antenna and the second end element 322 is the second radiator of the second partial antenna. More briefly, the first radiator of the first partial antenna is only called the first radiator, the second radiator of the first partial antenna only the second radiator, the first radiator of the second partial antenna only the third radiator and the second radiator of the second partial antenna only the fourth radiator. Between the first 311 and second 312 radiator there is only a narrow slot travelling across the upper surface of the substrate, partly in its longitudinal direction, the second radiator receiving its feed electromagnetically over the slot. Seen from the feed point FP, the outer end of the first radiator 311 continues from the upper surface of the substrate, where the common element 330 mostly is located, to the front surface of the substrate. Correspondingly, the end of the second radiator 312 nearest to the feed point FP continues from the upper surface of the substrate to the back surface of the substrate. The second radiator covers also the first head surface of the substrate 340 and extends a little to its lower surface, where it connects to the signal ground, or ground plane GND, when the antenna component has been mounted. Correspondingly, in this example only a narrow slot travelling across the upper surface of the substrate is between the third 321 and fourth 322 radiator, the fourth radiator receiving its feed electromagnetically over this slot. The fourth radiator covers also the second head surface of the substrate and extends a little to its lower surface, where it connects to the ground plane, when the antenna component has been mounted. By means of this kind of radiator structures together with the ceramic substrate the antenna can be made in very small size.

According to the invention, the common element 330 is also connected to the ground plane GND from the short-circuit point SP, which is located opposite the feed point FP on the other edge of the upper surface of the substrate. Thus the distance between the short-circuit and feed points is about the width of the substrate, which is relatively small compared with the length of the substrate. The ground connection of the common element is implemented by the short-circuit conductor SC, which is located on the back surface of the substrate opposite the feed conductor FC viewed in the transverse direction of the substrate and extends a little to its lower surface for constituting a contact surface. The total matching of the antenna can be improved by means of such a short-circuit relatively close to the feed point, especially together with a matching component connected to the feed conductor.

The prefixes 'upper', 'lower', 'front' and 'back' are defined in this description and claims just on grounds of the location of the parts of the radiating conductor. So the lower surface of the substrate means its surface, coating of which is substantially only relatively small contact surfaces for mounting the antenna component, and the front surface means the surface, on which the feed conductor FC is located. The use position of the antenna component can naturally be any. 'The first head' means the head on the side of the first end element, and 'the second head' means naturally the opposite head in respect of the first head.

Figure 4:
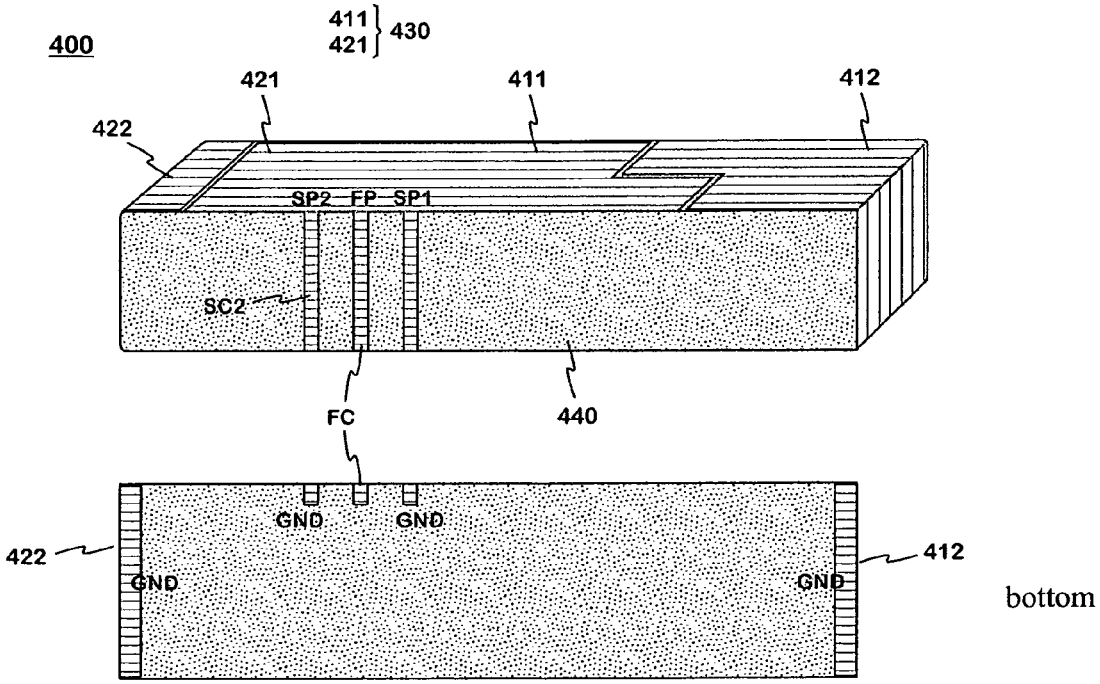
FIG. 4 shows a second exemplary embodiment of a dielectric dual antenna according to the invention.

FIG. 4 shows a second example of the dielectric dual antenna according to the invention. In the figure the antenna component 400 is seen from the front side as a perspective depiction and in the second partial figure from below. The antenna component comprises a substrate 440 shared between the partial antennas and the radiating elements of the antenna as conductor coatings of the substrate. The substrate 440 is also in this example an elongated ceramic piece shaped substantially like a right-angled prism, and on its surface there are the common element 430, the first end element 412 and the second end element 422 as in FIG. 3. The substantial difference to the structure shown in FIG. 3 is that there are now two short-circuit conductors of the common element instead of one, and these both conductors are located on the front surface of the substrate. A little from the feed point FP towards the first head of the substrate there is the first short-circuit point SP1, which is connected to the ground plane GND by the first short-circuit conductor SC1 next to the feed conductor FC. A little from the feed point FP towards the second head there is the second short-circuit point SP2, which is connected to the ground plane by the second short-circuit conductor SC2 on the other side of the feed conductor.

By means of two short-circuits close to the feed point the antenna impedances on the lower and upper operating band can be set so that a further improvement of the matching by an extra component in either operating band does not degrade the matching in the other operating band at the same time.

Figure 5:
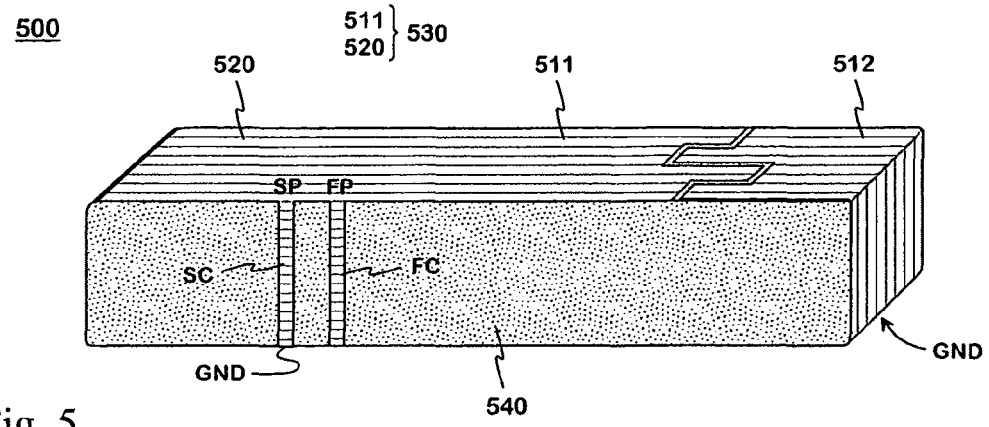
FIG. 5 shows a third exemplary embodiment of a dielectric dual antenna according to the invention.

FIG. 5 shows a third example of the dielectric dual antenna according to the invention. In the figure the antenna component 500 is seen from the front side as a perspective depiction. The antenna component comprises a substrate 540 shared between the partial antennas and the radiating elements of the antenna as conductor coatings of the substrate. On the surface of the substrate there are the common element 530 and the first end element 512 as in FIGS. 3 and 4. The difference to the structure shown in those figures is that the second partial antenna now comprises only one radiator 520 which, together with the first radiator like the one in the foregoing examples, constitutes the common element 530. The radiator 520 of the second partial antenna, or the third radiator, covers the upper surface of the substrate 540 on the side of the second head and can extend to the second head surface, but not there from onwards to the ground plane, being then open at its outer end. The common element has in this example one short-circuit conductor SC, which is located on the front surface of the substrate next to the feed conductor FC on the side of the second head. For this short-circuit conductor the second partial antenna can be considered to be of PIFA type, if the antenna ground plane is extended below the third radiator 520. The same short-circuit also effects on the matching of the first partial antenna at the same time.

Figure 6:
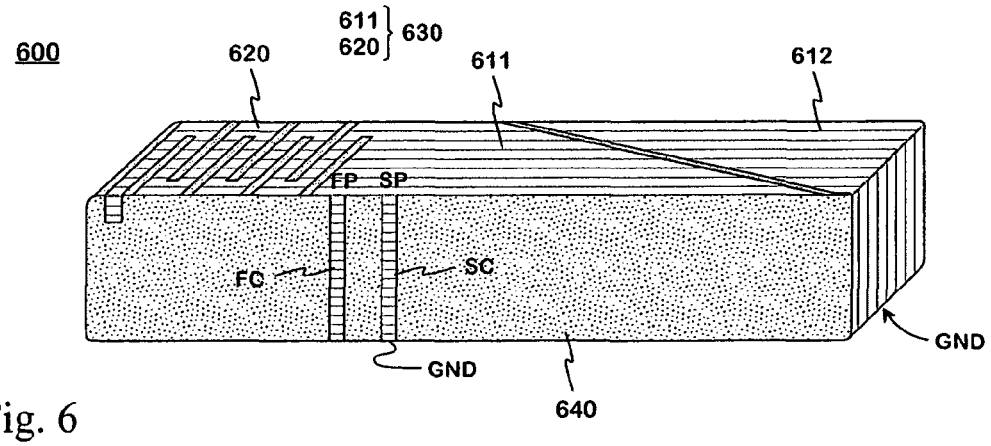
FIG. 6 shows a fourth exemplary embodiment of a dielectric dual antenna according to the invention.

FIG. 6 shows a fourth example of the dielectric dual antenna according to the invention. There the second partial antenna comprises only one radiator 620, which is not grounded from its outer end, as in the example of FIG. 5. The difference to the structure shown in FIG. 5 is that the third radiator 620 now is meander-shaped. In addition, now the short-circuit conductor SC of the common element 630 is located on the side of the first head in respect of the feed conductor FC.

Figure 7:
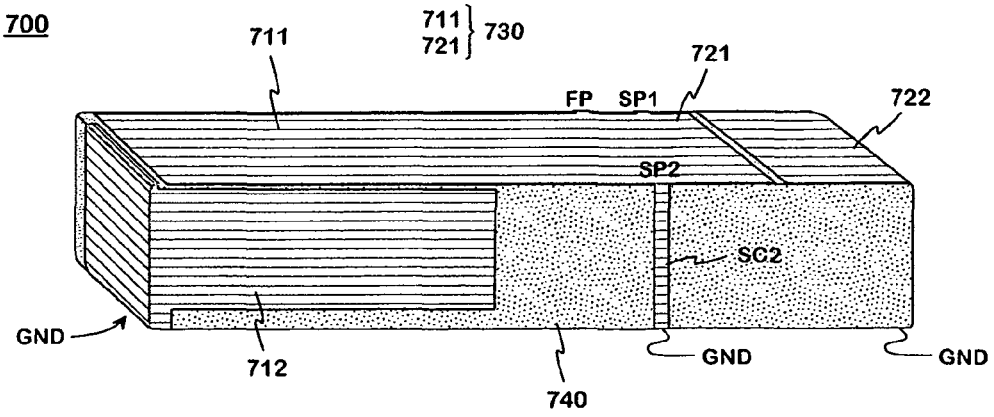
FIG. 7 shows a fifth exemplary embodiment of a dielectric dual antenna according to the invention.

FIG. 7 shows a fifth example of the dielectric dual antenna according to the invention. In the figure the antenna component 700 is seen from the back side as a perspective depiction. The common element 730 belonging to it comprises two short-circuit points and conductors, as in FIG. 4, but now the second short-circuit conductor SC2 is located on the back surface of the substrate 740, the first short-circuit conductor being located on the front surface of the substrate next to the feed conductor. An additional difference to the structure shown in FIG. 4 is that now the second radiator 712 of the first partial antenna is mostly located on the back surface of the substrate. It covers also the first head surface of the substrate so that the slot between the first 711 and second 712 radiator travels across the upper surface of the substrate close to the first head and continues then along the upper edge of the back surface towards the second head. Here the first radiator 711 is wholly located on the upper surface of the substrate.

Figure 8:
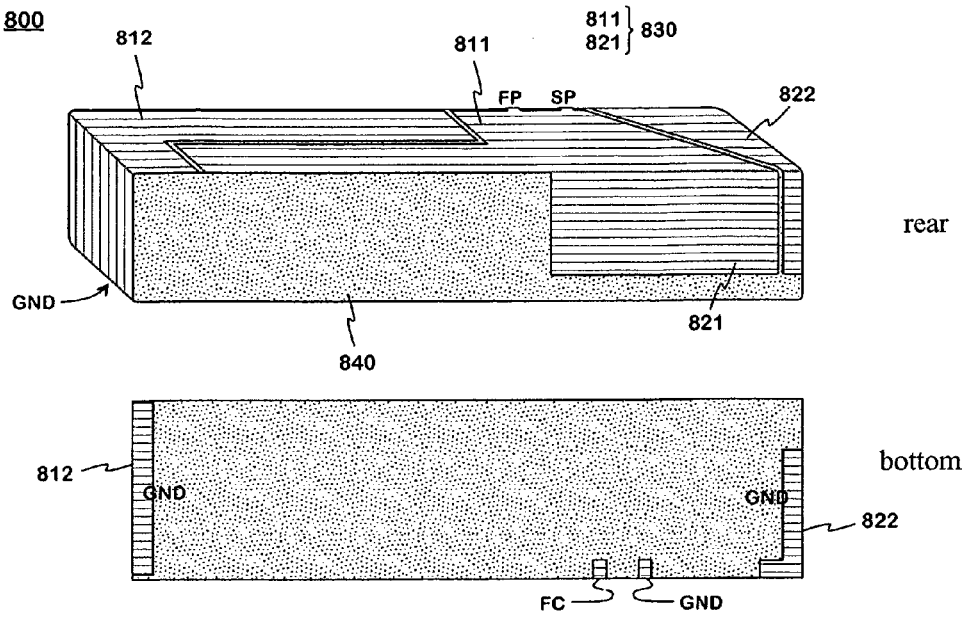
FIG. 8 shows a sixth exemplary embodiment of a dielectric dual antenna according to the invention.

FIG. 8 shows a sixth example of the dielectric dual antenna according to the invention. In the figure the antenna component 800 is seen from the back side as a perspective depiction and in the second partial figure from below. There the common element 830 has a single short-circuit conductor and this conductor is located on the front surface of the substrate 840 next to the feed conductor. Here the common element continues from the upper surface of the substrate to the back surface on the area, which extends in the longitudinal direction from the point opposite to the feed point FP near to the second head. In this case especially the first radiator 821 of the second partial antenna extends also to the back surface. Also a part of the second radiator 822 of the second partial antenna is located on the back surface, the large part of it being located on the upper surface and the second head surface. The first 811 and second 812 radiator of the first partial antenna are located so that the slot between them on the upper surface of the substrate starts on the side of the front surface close to the feed point FP, travels longitudinally in the middle of the upper surface to a point relatively close to the first head and turns after that sideways towards the back surface. The second radiator 812 can extend from the upper surface also on the side of the front surface.

Figure 9:
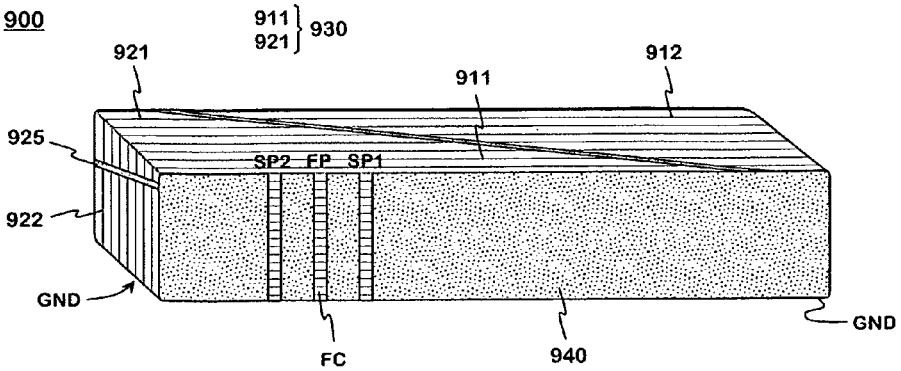
FIG. 9 shows a seventh exemplary embodiment of a dielectric dual antenna according to the invention.

FIG. 9 shows a seventh example of the dielectric dual antenna according to the invention. In the figure the antenna component 900 is seen from the front side as a perspective depiction. There are a short-circuit conductor on both sides of the feed conductor FC, as in FIG. 4. The difference to the structure shown in FIG. 4 is that now the slot 925 between the radiators 921, 922 of the second partial antenna is located on the second head surface instead of the upper surface. At the other edge of the common element 930, the slot between the radiators 911, 912 of the first partial antenna starts here on the side of the front surface close to the first head and travels diagonally across the upper surface to the side of the back surface close to the second head.

Figure 10:
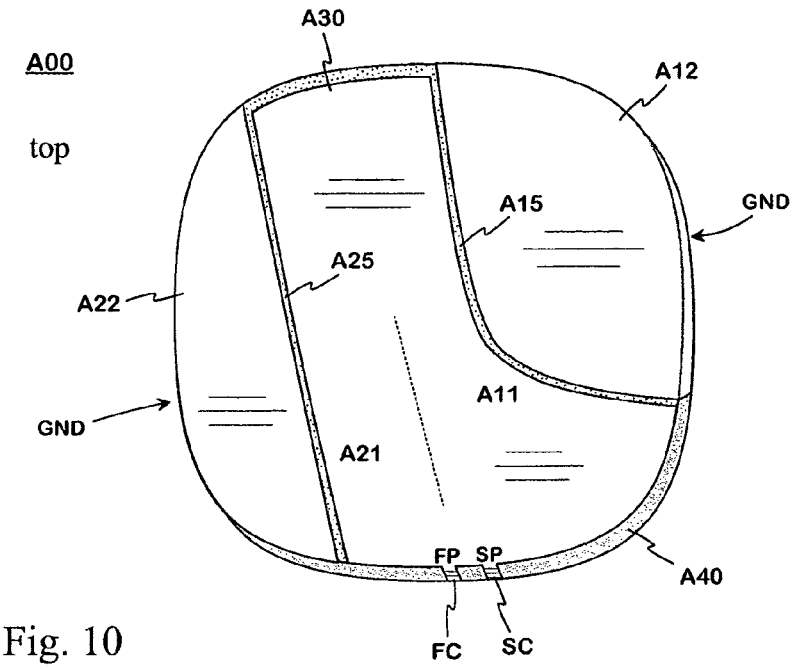
FIG. 10 shows an eighth exemplary embodiment of a dielectric dual antenna according to the invention.

FIG. 10 shows an eighth example of the dielectric dual antenna according to the invention. Seen from above, the substrate of the antenna component A00 is in this example a rounded plate so that its front surface, back surface and head surfaces all have roughly the same size. Parallelly at a place on the front surface there are the antenna feed conductor FC and the short-circuit conductor SC of the common element A30. Also in this case the slot A15 between the radiators A11, A12 of the first partial antenna and the slot A25 between the radiators A21, A22 of the second partial antenna make boundaries of the common element. The former slot makes a curved line across the upper surface of the substrate from the side of the first head surface to the side of the back surface, and the latter slot A25 travels across the upper surface of the substrate from the side of the front surface to the border area of the back surface and the second head surface. One radiator of both partial antennas are intended to be connected to the ground from their outer edge, seen from the common element A30.

Figure 11:
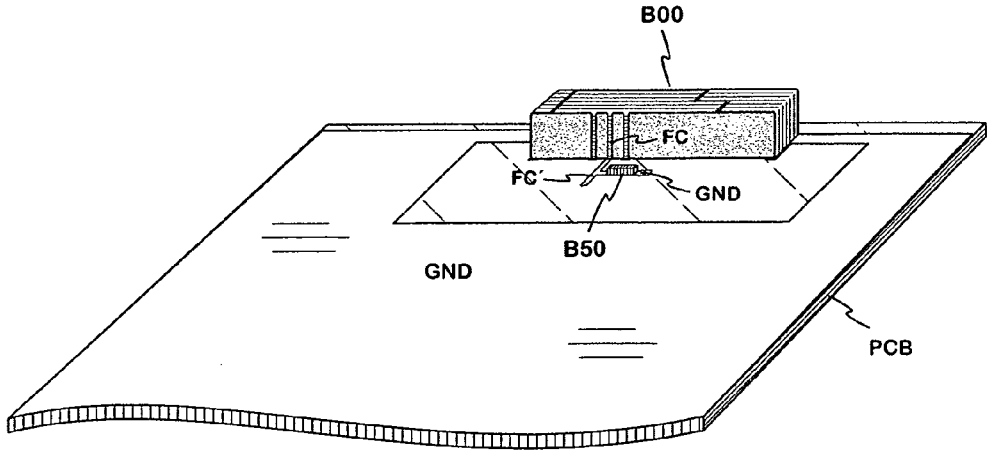
FIG. 11 shows another embodiment of a dielectric dual antenna according to the invention as mounted.

FIG. 11 shows an example of a dielectric dual antenna according to the invention as mounted. A part of the circuit board PCB of a radio device is seen in the figure, the upper surface of the board largely being of conductive ground plane. In this example the antenna component B00 has been fastened from its lower surface to the circuit board close to its one end. The feed conductor FC on the front surface of the antenna component continues on the circuit board as a conductor FC'. Between this conductor FC' and the signal ground there is connected the reactive matching component B50 of the antenna. In addition to the design of the antenna component itself, the antenna impedances in the operating bands naturally depend on several factors such as the size of the circuit board, the place of the antenna component on the circuit board, the shape of the ground plane and the other conductive parts of the device. Depending on the case, the matchings can succeed also without a discrete matching component. The edge of the ground plane GND is in the example of FIG. 11 at a certain distance from the antenna component B00 in its transverse direction. That distance is a variable in the antenna design. The antenna can be designed also so that the ground plane extends at least partially below the antenna component.

Figure 12:
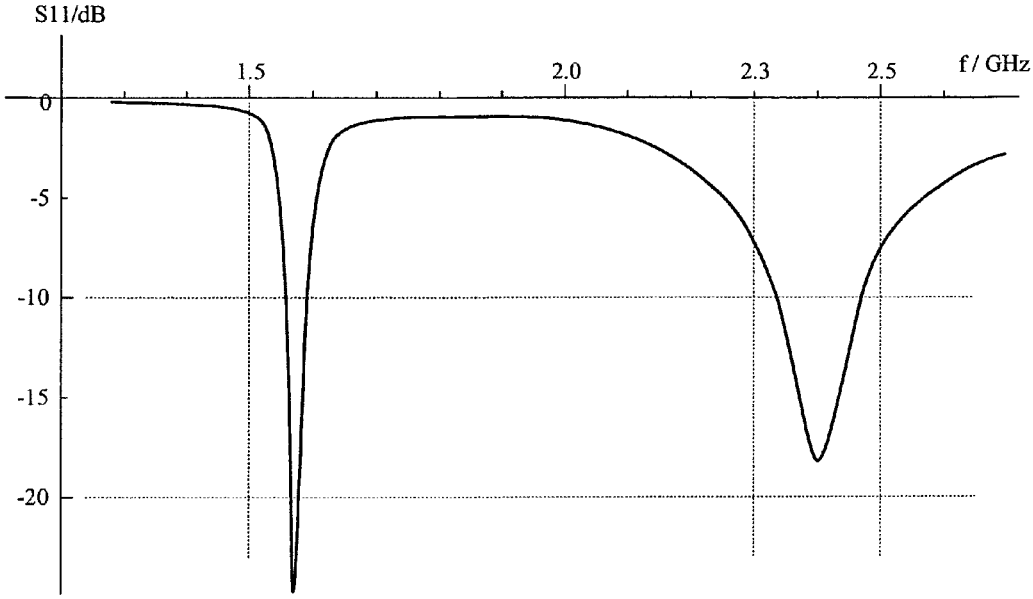
FIG. 12 shows exemplary band characteristics of one embodiment of an antenna according to the invention.

FIG. 12 shows an example of the band characteristics of an antenna according to the invention. The curve shows the fluctuation of the reflection coefficient S11 as a function of frequency. The lower reflection coefficient, the better the antenna has been matched and the better it functions as a radiator and a receiver of radiation. The antenna has been designed so that its lower operating band covers the narrow range at the frequency 1575 MHz used by the GPS (Global Positioning System). The upper operating band again well covers the frequency range used by the WLAN system (Wireless Local Area Network), which range is 2400-2484 MHz in the EU countries and the USA. Correspondingly the antenna could be designed so that the lower operating band would cover e.g. the frequency range used by the GSM900 system and the upper operating band cover e.g. the frequency range used by the GSM1800 system. The efficiency of the antenna according to the invention is good especially in the upper operating band considering the small size (for example 15 mm·3 mm·4 mm) of the antenna. In the free space the efficiency is typically about 50% in the lower operating band and about 60-70% in the upper operating band.

An antenna according to the invention can naturally differ in its details from the ones described. The shapes of the radiating elements can vary also in other ways than what appears from the examples. Also the shape of the substrate can vary. The places of the short-circuits of the common element can vary regardless of the number and shapes of the radiators. The substrate can be instead of ceramic, also of other dielectric material, as pure silicon. In this case the antenna is manufactured by growing a metal layer on the surface of the silicon and removing a portion of it with a technology used in manufacturing of semiconductor components. The inventive idea can be applied in different ways within the limitations set by the independent claim 1.

What is claimed is:

1. A dual band antenna comprising:

a substrate comprising a width and a length, said substrate further comprising:

a first antenna operating at a first operating band; and a second antenna operating at a second operating band, said second operating band substantially differing from said first operating band;

wherein said first antenna and said second antenna share a feed point and a feed conductor, and at least one of said first or second antennas comprises a first radiator and a second radiator, and at least one of said antennas comprises a third radiator; and wherein said first radiator comprises said feed point and said second radiator comprises a first end and a second end, said second end coupled to a ground and disposed farther from said first radiator than said first end.

2. The antenna of claim 1, wherein said length is larger than said width, and said first radiator further comprises at least one short circuit point and at least one short circuit conductor associated therewith, the distance between said at least one short circuit point and said feed point being no larger than said width.

3. The dual band antenna of claim 2, wherein the number of said at least one short circuit points is one, said short-circuit conductor located on a back surface of said substrate opposite a front surface comprising said feed conductor.

4. The dual band antenna of claim 2, wherein the number of said at least one short circuit points is one, said short-circuit conductor located on the same surface as said feed conductor.

5. The dual band antenna of claim 2, wherein the number of said at least one short circuit points is two, and wherein a first short-circuit conductor comprising a first short-circuit point is located on the same surface of the substrate as the feed conductor, and a second short-circuit conductor comprising a second short-circuit point is located on the same surface of the substrate as the feed conductor and on the opposite side of the feed conductor as said first short-circuit conductor.

6. The dual band antenna of claim 2, wherein the number of said at least one short circuit points is two, wherein a first short-circuit conductor comprising a first short-circuit point is located on the same surface of the substrate as the feed conductor and a second short-circuit conductor comprising a second short-circuit point is located on a surface of the substrate opposite the feed conductor and said first short-circuit conductor.

7. The dual band antenna of claim 1, wherein said first and second radiators are separated from each other by a narrow slot.

8. The dual band antenna of claim 7, wherein the first radiator is wholly located on an upper surface of the substrate.

9. The dual band antenna of claim 7, wherein at least one of the first or second radiators extends from an upper surface of the substrate to a front or a back surface.

10. The dual band antenna of claim 9, wherein a majority of the second radiator is located on the back surface of the substrate.

11. The dual band antenna of claim 7, wherein the majority of the slot separating the first and second radiators is located on an upper surface of the substrate.

12. The dual band antenna of claim 11, wherein the third radiator comprises a meandering shape.

13. The dual band antenna of claim 1, further comprising a reactive matching component electrically disposed between the feed conductor and a signal ground.

14. The dual band antenna of claim 1, wherein said substrate comprises a ceramic material.

15. The method of claim 14, wherein one of said lower and upper bands comprises a global positioning system (GPS) band, and the other of said lower and upper bands comprises a wireless local area network (WLAN) band.

16. The dual antenna according to claim 1, wherein said at least on short-circuit point comprises a single point, and a short-circuit conductor communicating with said single point is located in majority on the front surface of the substrate on at least one side of the feed conductor.

17. A dual antenna according to claim 1, wherein said at least one point comprises first and second points, and a first short-circuit conductor communicating with the first short-circuit point is located substantially on the front surface of the substrate on one side of the feed conductor, and a second short-circuit conductor communicating with the second short-circuit point is located substantially on the front surface of the substrate on the other side of the feed conductor.

18. A method of operating a dual band antenna comprising one partial antenna associated with a lower operating band of the antenna and a second partial antenna associated with an upper operating band, said partial antennas having a shared substrate, a shared feed point, wherein said method comprises:

operating at least one of the partial antennas as two radiators;

operating said first radiator and the radiator of the other partial antenna, which joins the shared feed point, as a unitary common element on the substrate surface; and short-circuiting said common element to ground from at least one point proximate to the feed point.

19. A dual antenna of a radio device comprising:

a first partial antenna to implement a lower operating band of the antenna;

a second partial antenna to implement an upper operating band, said first and second partial antennas having a shared dielectric substrate which forms an integrated antenna component together with antenna radiators, the partial antennas having a shared feed poing and a shared feed conductor on the front surface of the substrate;

wherein a part of the antenna component in one direction from a substrate cross section which leads through the feed point belongs to the first partial antenna, and a part of the antenna component in the opposite direction belongs to the second partial antenna;

wherein at least one partial antenna comprises two radiators, the first of which joins the feed point and the second of which is adapted for connection to a ground plane; and wherein said first radiator and a radiator of the other partial antenna joining the shared feed point form a unitary common elements on the upper surface of the substrate, which element is configured for connection to the ground plane from at least one short-circuit point proximate to the feed point.

20. The dual antenna according to claim 19, wherein said at least one said short-circuit point comprises a single point, and said antenna further comprises a short-circuit conductor communicating with said single point is located on back surface of the substrate substantially opposite the feed conductor.

21. An antenna component for use in a radio frequency device comprising:

a first partial antenna implementing a lower operating band; and a second partial antenna implementing an upper operating band, said first and second partial antennas comprising:

a shared dielectric substrate;

a shared feed point; and a shared feed conductor disposed on a front surface of the substrate;

wherein:

a part of the antenna component in a first direction relative to a cross-section of the substrate which leads through the feed point is associated with the first partial antenna; and a part of the antenna component in the opposite direction is associated with the second partial antenna.

22. The antenna component of claim 21, wherein at least one of said first or second partial antennas comprises two radiators, the first of which joins galvanically at the feed point, and the second of which is connected to a ground plane from an outer end; and wherein said first radiator and a radiator of the other partial antenna joining the shared feed point form a unitary common element on the upper surface of the substrate.

23. The antenna component of claim 22, wherein said unitary common element is connected to the ground plane from at least one short-circuit point proximate to the feed point.

24. The antenna component of claim 23, wherein said at least one short-circuit point comprises one point of the unitary common element, and further comprising a short-circuit conductor in communication with said one point and located on a back surface of the substrate opposite the feed conductor.

25. The antenna component of claim 23, further comprising a short-circuit conductor starting from said at least one point and located on the front surface of the substrate.

26. The antenna component of claim 23, wherein said at least one short-circuit point of the common element comprises first and second points, and said component further comprises a first short-circuit conductor starting from said first short-circuit point and located at least partly on the front surface of the substrate on one side of the feed conductor, and a second short-circuit conductor starting from said second short-circuit point located at least partly on the front surface of the substrate on the other side of the feed conductor than said first short-circuit conductor.

27. The antenna component of claim 23, wherein said at least one short-circuit point comprises first and second points, and further comprises a first short-circuit conductor communicating with the first short-circuit point and located on the front surface of the substrate next to the feed conductor, and a second short-circuit conductor communicating with said second short-circuit point and located on a back surface of the substrate opposite the feed conductor.

28. The antenna component of claim 22, wherein the first radiator which joins galvanically at the feed point and the second radiator comprises the first partial antenna, said first and second radiator being separated from each other by a slot, said second radiator extending through a first surface of the substrate to a lower surface of the substrate for connection to the ground plane.

29. The antenna component of claim 28, wherein the first radiator of the first partial antenna is wholly located on the upper surface of the substrate.

30. The antenna component of claim 25, wherein at least one of the radiators of the first partial antenna extends from the upper surface of the substrate to at least one of a front or a back surface.

31. The antenna component of claim 30, wherein a majority of the second radiator of the first partial antenna is located on the back surface of the substrate.

32. The antenna component of claim 28, wherein the second partial antenna comprises two radiators separated from each other by a slot, a first radiator of which joins galvanically the feed point, and the second radiator of the second partial antenna extending through a second surface of the substrate to a lower surface of the substrate for connection to the ground plane.

33. The antenna component of claim 32, wherein the slot is substantially located on the upper surface of the substrate.

34. The antenna component of claim 32, wherein the first and second radiator of the second partial antenna and the slot between these radiators extend from the upper surface of the substrate to its back surface.

35. The antenna component of claim 32, wherein the slot between the first and second radiator of the second partial antenna is located on a second head surface of the substrate.

36. The antenna component of claim 28, wherein the second partial antenna comprises only one radiator which covers at least a part of the upper surface of the substrate.

37. The antenna component of claim 36, wherein the radiator of the second partial antenna is meander-shaped.

38. The antenna component of claim 22, further comprising a reactive matching component connected between an antenna feed conductor and a signal ground.

39. The antenna of claim 22 wherein said shared substrate comprises a ceramic material.

40. An antenna component for use in a radio frequency device comprising:

a first partial antenna implementing a lower operating band;

a second partial antenna implementing an upper operating band, said first and second partial antennas comprising a shared dielectric substrate; and a reactive matching component connected between an antenna feed conductor and a signal ground;

wherein;

a part of the antenna component in a first direction relative to a cross-section of the substrate which leads through the feed point is associated with the first antenna, and a part of the antenna component in the opposite direction is associated with the second partial antenna; and the first and second partial antennas comprise a shared feed point and a shared feed conductor disposed on a front surface of the substrate.

41. An antenna component for use in a radio frequency device comprising:

a first partial antenna implementing a lower operating band; and a second partial antenna implementing an upper operating band., said first and second partial antennas comprising a shared dielectric substrate, said shared substrate comprising a ceramic material;

wherein;

a part of the antenna component in a first direction relative to a cross-section of the substrate which leads through the feed point is associated with the first partial antenna and a part of the antenna component in the opposite direction is associated with the second partial antenna; and the first and second partial antennas comprise a shared feed point and a shared feed conductor disposed on a front surface of the substrate.

* * * * *